US009738412B1

(12) United States Patent
Victor

(10) Patent No.: US 9,738,412 B1
(45) Date of Patent: Aug. 22, 2017

(54) MATCHBOX-TYPE PACKAGING

(71) Applicant: Pocket Tea, LLC, New York, NY (US)

(72) Inventor: Daniel Victor, New York, NY (US)

(73) Assignee: POCKET TEA, LLC, New York, NY (US)

( * ) Notice: Subject to any disclaimer, the term of this patent is extended or adjusted under 35 U.S.C. 154(b) by 0 days.

(21) Appl. No.: 15/182,712

(22) Filed: Jun. 15, 2016

Related U.S. Application Data

(60) Provisional application No. 62/180,170, filed on Jun. 16, 2015, provisional application No. 62/251,156, filed on Nov. 5, 2015.

(51) Int. Cl.
*B65D 5/38* (2006.01)
*A24F 27/00* (2006.01)

(52) U.S. Cl.
CPC ..... *B65D 5/38* (2013.01); *A24F 27/00* (2013.01)

(58) Field of Classification Search
CPC ..... B65D 5/38; B65D 85/24; A45F 27/00
USPC ..... 229/125.125, 913; 206/121, 804, 815
See application file for complete search history.

(56) References Cited

U.S. PATENT DOCUMENTS 446,336 A 2/1891 Forshaw
1,004,565 A 10/1911 Gates
1,362,820 A 12/1920 Rinker
1,444,251 A 2/1923 Kirkbride
1,904,193 A 4/1933 Berg
1,953,418 A * 4/1934 MacDonald ..... B65D 5/721 206/249
2,241,660 A 5/1941 Ford
3,186,542 A * 6/1965 Greene ..... B65D 83/0847 206/449
3,282,465 A * 11/1966 Davis ..... A24F 15/14 206/250
D292,965 S 12/1987 Fein
4,940,190 A * 7/1990 Groves ..... A47G 21/001 206/559
5,611,536 A 3/1997 Foreshew
D536,245 S 2/2007 Bruun
7,992,708 B2 * 8/2011 Hein ..... B65D 5/38 206/249
8,061,586 B2 11/2011 Fluegel et al.
2007/0278115 A1 * 12/2007 Ghini ..... B65D 5/38 206/248
2015/0021329 A1 1/2015 Darmon
(Continued)

FOREIGN PATENT DOCUMENTS

FR 2535176 A1 5/1984
FR 2679874 A1 2/1993
GB 109928 10/1917
(Continued)

*Primary Examiner* — Christopher Demeree
(74) *Attorney, Agent, or Firm* — Edell, Shapiro & Finnan, LLC

(57) ABSTRACT

A matchbox-type container wherein the sleeve has a proximal end wall with an aperture defined therein, and the bottom has a slot or channel defined lengthwise therein in direct and longitudinally continuous communication with the proximal end wall aperture. The longitudinally continuous aperture and channel permit a user to pass a finger into the aperture and unimpededly lengthwise through the channel to cause the tray to be pushed and extended distally, thereby permitting the tray contents to be exposed through the open distal end of the sleeve.

14 Claims, 5 Drawing Sheets

(56) References Cited

U.S. PATENT DOCUMENTS

2016/0251107 A1* 9/2016 Everett ..... B65D 5/38

FOREIGN PATENT DOCUMENTS

| | | |
|---|---|---|
| GB | 161652 | 2/1937 |
| RU | 2062589 C1 | 6/1996 |

* cited by examiner

MATCHBOX-TYPE PACKAGING

CROSS REFERENCE TO RELATED APPLICATIONS

The present application claims priority from U.S. Provisional Patent Application Ser. No. 62/180,170 entitled "Improved Matchbox-Type Packaging," filed Jun. 16, 2015, and U.S. Provisional Patent Application Ser. No. 62/251,156 entitled "Improved Matchbox-Type Packaging," filed Nov. 5, 2015. The disclosures in these provisional patent applications are incorporated herein by reference in their entireties.

BACKGROUND

Technical Field

The present invention relates generally to a box-type package and, more particularly, to an improved matchbox-type package. The invention comprises a box having generally similar structure and function to that of a matchbox, although divergent in significant ways that allow for improved functionality and more efficient use.

Traditional matchbox structures have a rectangular parallelepiped sleeve, open at both ends, which totally transversely envelops a slidable tray. The tray has a similar parallelepiped configuration, open at its top, which is sized to be longitudinally slidable within the sleeve. Carrying a box of a traditional matchbox shape requires users who wear gloves (e.g., waiters, maître d's, busboys, downhill skiers, cross-country skiers, hikers, climbers, ice skaters, snowboarders, bicycle riders, motorcycle riders, or anyone residing in a seasonally-variant climate who might wear gloves to protect against the cold, etc.) to remove their gloves to fittingly insert a finger into one open end of the sleeve to push the tray out through the opposing open sleeve end. The invention disclosed herein allows the tray to be manipulated, and full access to the contents of the tray to be accessed, with one hand and without removing one's gloves.

The traditional matchbox continues to be efficient for certain products, such as matches, that are stored lengthwise in the tray (i.e., longitudinally in the direction of tray sliding motion in the sleeve) because a user need only push open the matchbox to a small degree to remove a match from the tray. The present invention dramatically improves the matchbox structure for all products, particularly products that are oriented transversely of the structure (i.e., lengthwise in a width-wise direction within the tray). For products thusly oriented the traditional matchbox design and similar prior art packages are inefficient because it is very difficult to fully-access the products. That is, most men, and many women, are unable to push their fingers far enough into the sleeve to expose a sufficient length of the tray at its proximal end to permit full access to the contained products. As a result, to access all the contents of a box that are oriented transversely of the tray requires a user to manipulate the box with two hands. The present invention allows anyone to manipulate the box and render the full contents of the box totally accessible with one hand.

OBJECTS AND SUMMARY OF THE INVENTION

Therefore, in light of the above, and for other reasons that become apparent when the invention is fully described, it is one object of the present invention to provide an improvement in matchbox type packages that permits user's to readily access the package contents while wearing gloves and with the use of only one hand.

The present invention is an improvement over a conventional matchbox container of the type wherein an open tray is slidably contained in a sleeve. Whereas the conventional matchbox sleeve is open at both ends and closed at it top bottom and sides, the sleeve of the present invention has a proximal end wall with an aperture defined therein, and the bottom has a slot or channel defined lengthwise therein in direct and longitudinally continuous communication with the proximal end wall aperture. The longitudinally continuous aperture and channel permit a user to pass a finger into the aperture and then uninterruptedly lengthwise through the channel to cause the tray to be pushed and extended distally to thereby permit the tray contents to be exposed through the open distal end of the sleeve.

The container of the present invention is of the matchbox type comprising a tray having proximal and distal ends, a sleeve for receiving the tray in longitudinally slidable relation distally within the sleeve, wherein said sleeve comprises: an open distal end configured to permit the distal end of the tray to be extended distally therefrom; a proximal end wall having a bottom edge and an aperture defined through the proximal end wall at the bottom edge; and a bottom wall having a longitudinally extending slot defined therethrough and extending distally from and in direct longitudinally continuous (i.e., uninterrupted) communication with the aperture; wherein the aperture and slot are configured to permit a user to expose contents of said tray by inserting a finger through the aperture and then uninterruptedly into an through the slot to push against the proximal end of the tray.

The above and still further features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

Figure 1:
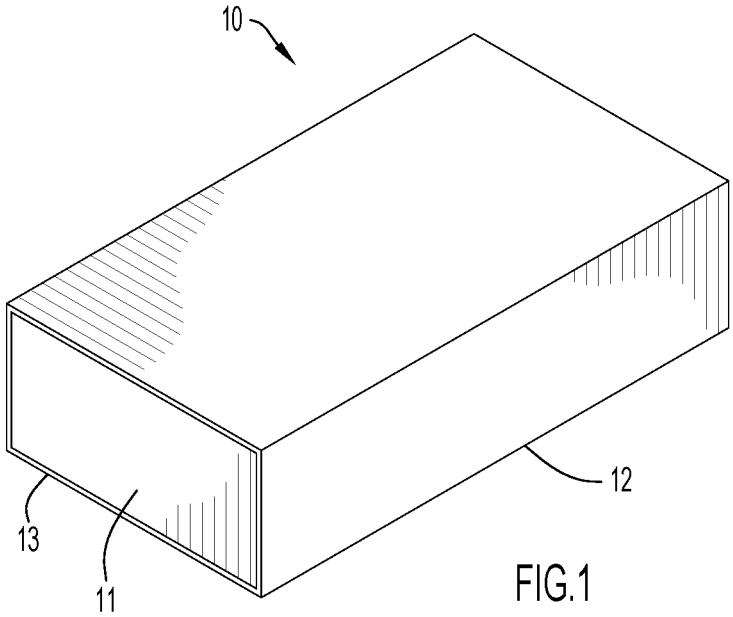
FIG. 1 is a front view in perspective from above of a container shown closed according to one preferred embodiment of the present invention.
Figure 2:
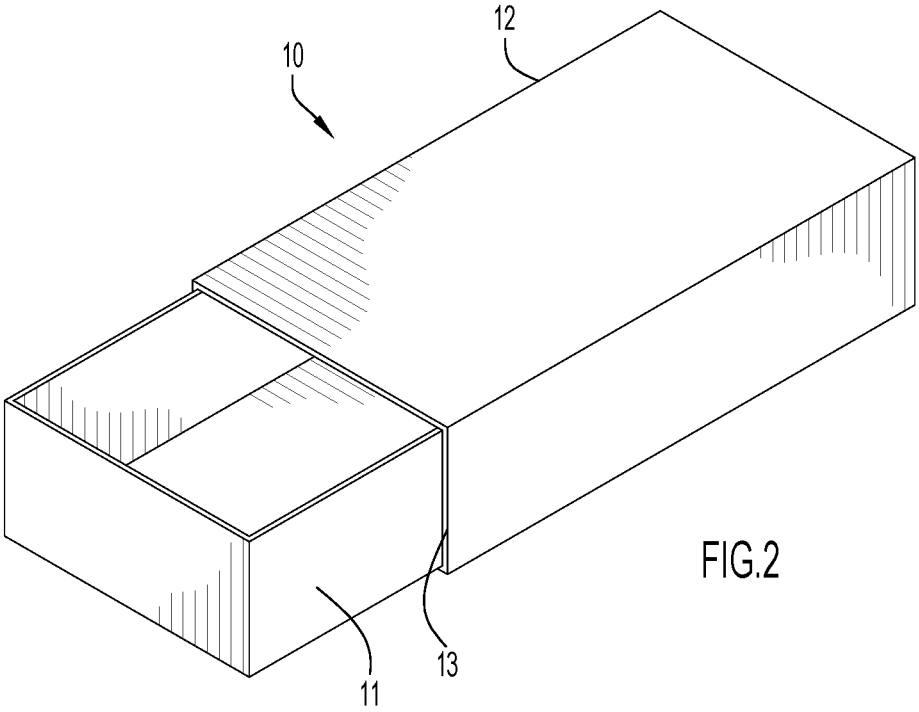
FIG. 2 is a front view in perspective from above of the container of FIG. 1 shown partially open.

It is intended that the description below not be limited to terms of orientation that are used for convenience and ease of understanding. Specifically, it is to be understood that terms such as "top", "bottom", "front", "rear", "side", "length", "width", "transverse", "upper", "lower", "interior", "exterior", "inner", "outer" and the like as may be used herein, merely describe points of reference and do not limit the present invention to any particular orientation or configuration. In addition, the specific dimensions set forth below are by way of example for particular embodiments to assist in an understanding of the illustrated structure; these dimensions are not to be construed as limiting the scope of the invention.

Referring specifically to FIGS. 1-4 and 6, the container 10 of the present comprises a tray 11 arranged to be sealed when fully-enclosed in a sleeve 12. In this preferred embodiment of the invention the sleeve 12 is a rectangular parallelepiped having an open distal end 13 and an opposite proximal end wall 14. Proximal end wall 14 is closed except for an arched aperture 15 defined therethrough having spaced ends terminating at the bottom wall 16 of the sleeve and extending approximately halfway up the otherwise closed end wall 14. In this embodiment of the invention aperture 15 takes the form of a segment of a circle that is semi-circular or slightly smaller that a semi-circle. The sidewalls and top wall of the sleeve are preferably entirely closed. The bottom wall 16 of the sleeve is closed except for a channel 17 cut therethrough and extending distally lengthwise from the proximal end wall 14 in communication with aperture 15. In other words, channel 17 has an open proximal end coterminous with the bottom open edge of aperture 15. The distal end 18 of channel 17 is closed and, in this embodiment, is arcuate with a shape matching that of aperture 15. It should be noted that the distal end 18 of the channel need not be arcuate and can take any configuration that is consistent with the functions and operation described herein.

Tray 11 is in the form of a rectangular parallelepiped open at its top with entirely closed walls at its front, back, sides and bottom. The tray is sized to closely fit inside sleeve 12 in longitudinally slidable relation in the same manner as in a conventional matchbox. Tray 11 serves to receive and contain package contents (e.g., matches, pills, candies, tea leaf portions, pouches, tobacco, etc.) which are typically inserted into and removed from the open tray top.

Figure 6:
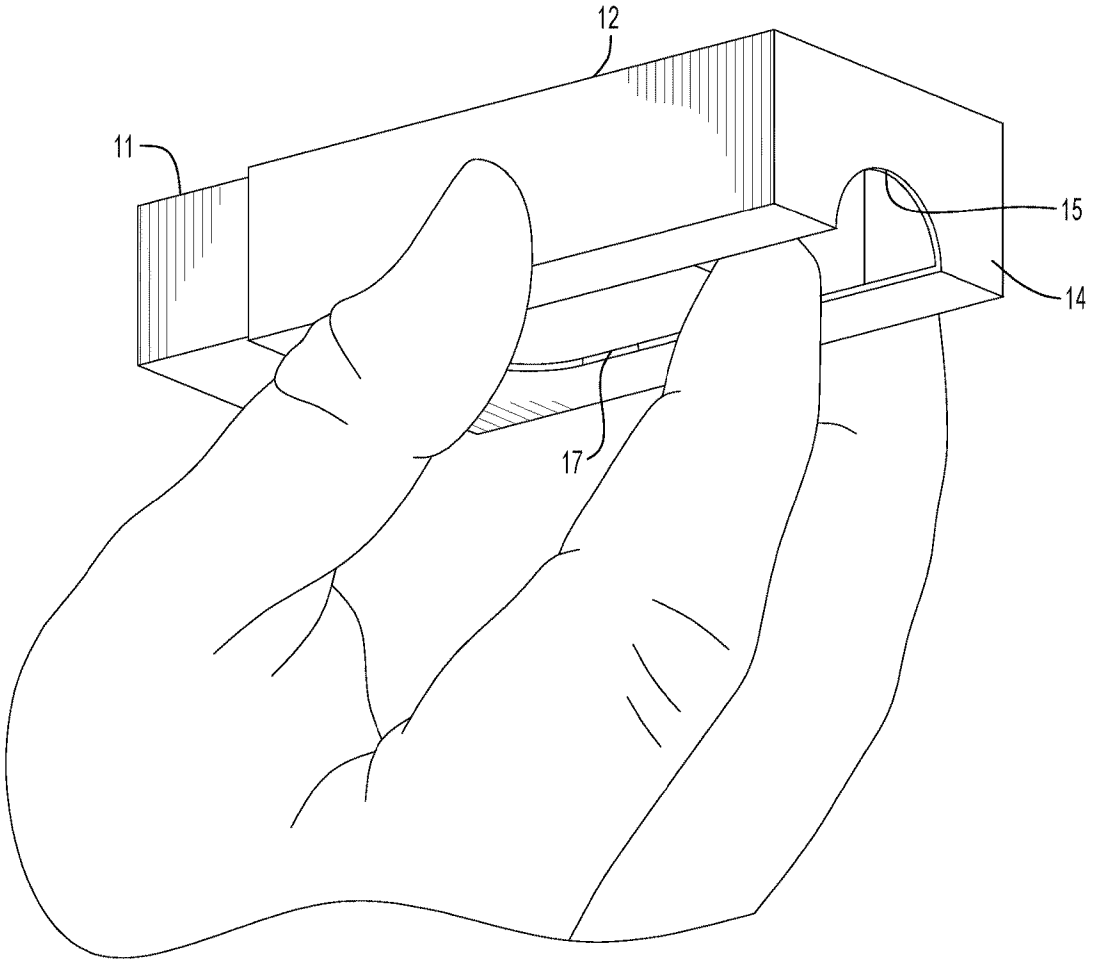
FIG. 6 is a diagrammatic view in perspective showing the container of FIG. 1 being opened by a user.

Aperture 15 allows a finger to be introduced therethrough and then extended in the sleeve along channel 17. Channel 17 extends from aperture 15 for a distance typically between fifty and ninety percent of the length of the sleeve. As illustrated in FIG. 6, this allows a user's single finger, typically an index finger, to push the tray 11 from the proximal end 14 of the sleeve along the channel 17 as necessary to expose the desired amount of the contents inside the open top tray. Such manipulation can occur with the user's index finger while the sleeve is grasped between the user's thumb and other digits of the same hand. For products that are stored width-wise within the tray, these products can all be accessed as the tray is fully-extended. It is very difficult for a large segment of the population, if not almost everyone, to extend a tray fully by pushing a finger through an open ended sleeve of a traditional matchbox which can have an open proximal sleeve end as narrow as five millimeters; and which action, even were it to be successful, would necessarily require the use of the user's other hand to pull the tray from the distal end.

Typically the container components may be made of plastic, metal, cardboard or any suitable material consistent with the properties and functions described herein. In the illustrated embodiment the width of channel 17 transversely of the sleeve is between 36%-66% of the sleeve width, although in some embodiments the channel can be between 10%-90% of the width of the sleeve. The length of the channel is optimally 50%-85% of the length of the sleeve but the channel can be between 5%-95% of the length of the sleeve for some embodiments depending, for example, on the materials used and the structural rigidity of the sleeve. Importantly, the channel width (and the aperture diameter) must be sufficient to receive the tip of an index finger of a person (possibly a gloved index finger), and for this purpose should be at least 12 mm, and preferably about 18 mm.

With regard to typical overall dimensions, by way of example only, the embodiment of FIG. 1 may have the following approximate dimensions:

| | |
|---|---|
| Length of sleeve 12: | 67 mm |
| Width of sleeve 12: | 37 mm |
| Depth of sleeve 12: | 20 mm |
| Length of channel 17: | 55 mm |
| Width of channel 17: | 18 mm |
| Width of aperture 15: | 18 mm |
| Height of aperture 15: | 6 mm |
| Length of tray 11: | 64 mm |
| Width of tray 11: | 35 mm |
| Depth of tray 11: | 19 mm |

Figure 7:
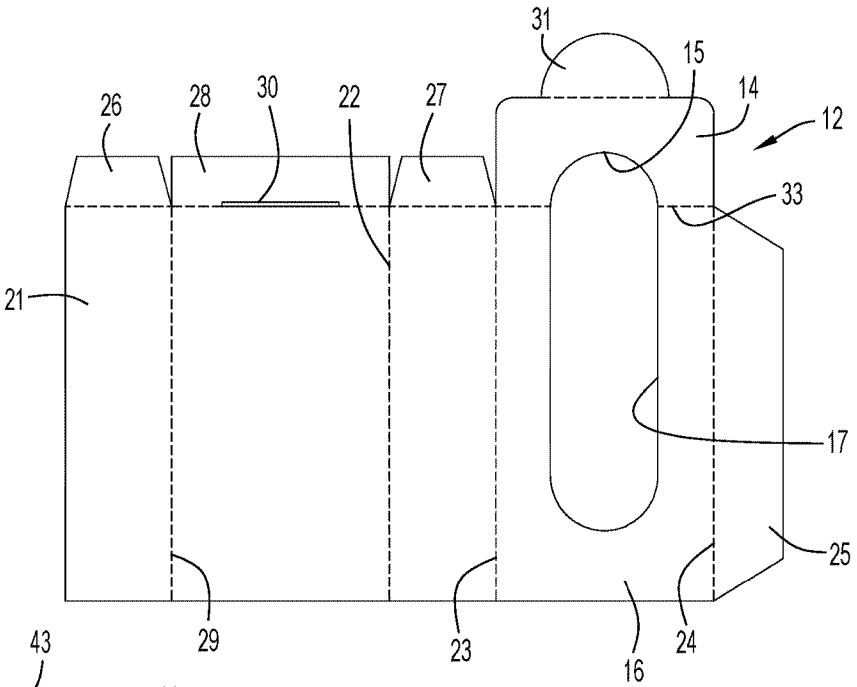
FIG. 7 is a plan view of a blank from which the sleeve member in the embodiment of FIG. 1 is formed.
Figure 8:
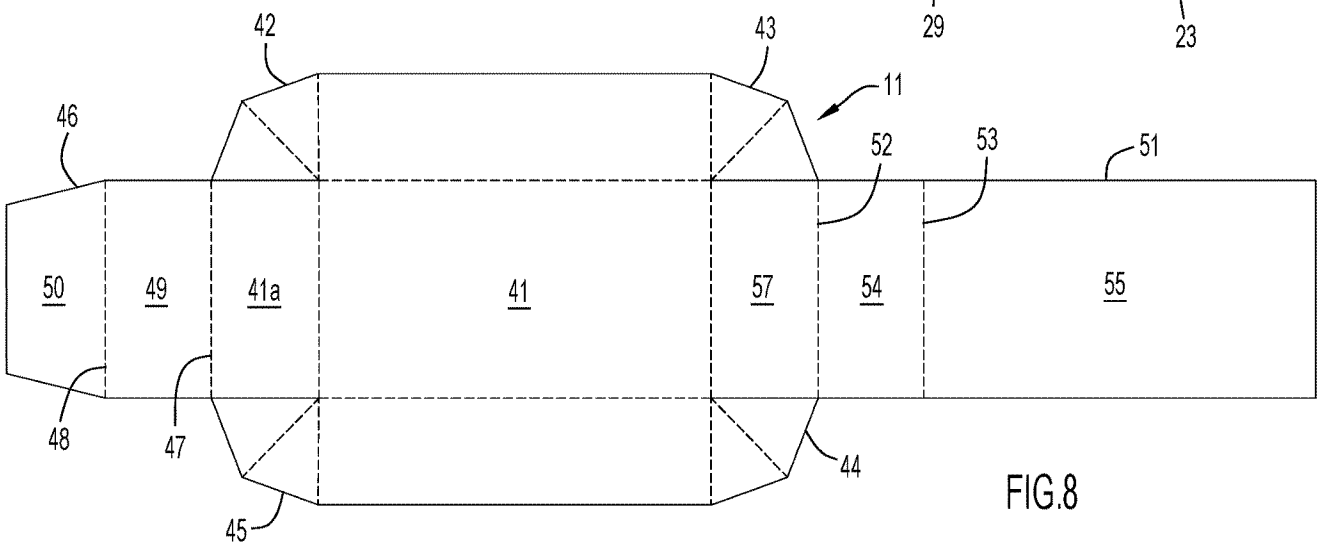
FIG. 8 is a plan view of a blank from which the tray member in the embodiment of FIG. 1 is formed.

Blanks for a cardboard embodiment of the embodiment described above are illustrated in FIG. 7 (for the sleeve) and FIG. 8 (for the tray), it being understood that the tray and sleeve components are formed by folding the blanks along indicated dashed lines and securing the sections as necessary with adhesive or other means. Referring to the sleeve blank in FIG. 7, the sidewalls are folded toward one another along fold lines 22, 29, respectively, out from the plane of the drawing until perpendicular to the top wall. The sleeve bottom wall 16 is then folded along fold line 23 out of the plane of the drawing until perpendicular to the abutting sidewall. The tab 25 extending from the side of bottom wall 16 is then folded along fold line 24 until its outer surface (facing into the drawing plane in FIG. 7) abuts the interior surface of the opposite sidewall 21. Glue or other adhesive material is used to secure tab 25 to that abutting interior sidewall surface. Tabs 26, 27 at the proximal ends of the sidewalls are then folded so as to be perpendicular to their respective sidewalls, and tab 28 at the proximal end of the sleeve top wall is folded over folded tabs 26, 27 until perpendicular to the top wall. A slot 30 is defined transversely across tab 28 adjacent the juncture between that tab and the sleeve top wall and is configured to receive tab 31 extending from the top edge of proximal end wall 14. End wall 14 is folded along fold line 33 at the juncture between end wall 14 and bottom wall 16 until those walls are perpendicular, and tab 31 is folded and inserted into slot 30.

It should be noted that slot 17 and aperture 15 are formed as a single cut out in the sleeve blank. This assures the required longitudinal continuity between the aperture and slot in the assembled unit 10 that permits a user's finger to enter the slot from the aperture and push the tray to the desired extension from the open distal end of the sleeve.

As described, the sleeve blank illustrated in FIG. 7 is formed with fold lines between successive side, top and bottom sections along the long dimension of the edges of the sections. This configuration allows for gluing at a single location and permits the sleeve to be collapsed and shipped flat and then be easily manipulated into a three dimensional parallelepiped sleeve shape when received and assembled. The locking tab 31 at the top edge of the proximal closed end section retains that shape when inserted into the approximately 20 mm slot 30 formed in the rear fold line between the top of the sleeve and the flap 28 extending therefrom. Tab 31 may be slightly wider than the length of slot 30 and provided with notches at its opposite ends to facilitate locking of the tab in slot 30 in a conventional manner; this prevents inadvertent removal of the tab and unfolding of the sleeve proximal end wall 14. The projecting corners of the proximal end wall 14 are rounded so that they will not readily deform (i.e., bow out or bend) and will fit flat against the end of the tray in the assembled unit. Although this particular blank configuration has advantages, it will be appreciated that other blank configurations can be used to form a sleeve that functions as required for the present invention.

The tray blank in FIG. 8 has a rectangular base section 41 bounded on all four sides by respective fold lines comprising respective junctions with the side and end walls of the tray 11. Corner wing-like sections 42, 43, 44 and 45 extend between the side walls and adjacent end walls and include fold lines that permit the corner sections to be folded inwardly along those fold lines as the side and end walls are folded upwardly to form the tray parallelepiped structure. A short first extension section 46 extends from a fold line 47 at the top edge of one end wall (to the left in FIG. 8) and includes a transverse intermediate fold line 48 proximate its longitudinal center that divides the section into inner portion 49 and outer portion 50. Inner portion 49 has substantially the same configuration as its adjacent end wall 41*a*. Section 46 can be folded over its adjacent end wall along fold 47 and the folded corner sections 42 and 45, and then along intermediate fold line 48 so that the remote end 50 of section 46 resides in adjacent abutting relation to base section 41 to form an interior partial layer of the bottom wall of the tray.

A long second extension section 51 extends from a fold line 52 at the top edge of the opposite end wall and includes a transverse intermediate fold line 53 that divides it into a relatively short inner portion 54 and a substantially longer outer portion 55. Inner portion 54 has substantially the same configuration as its adjacent end wall 57 that shares fold line 52. Section 51 can be folded over its adjacent end wall and the folded corner section 43 and 44, along fold line 52, and then along intermediate fold line 53 so that the remote end portion 55 resides in adjacent abutting relation to base section 41, overlying the outer portion 50 of the extension at the opposite end of the tray, to form an interior part of the bottom wall of the tray. The length of portion 55 in the illustrated embodiment is substantially the same as the length of base 41 so that it almost entirely covers the base 41 and portion 50. The plural layers 41, 50 and 55 thusly forming the bottom wall of the tray add to the strength and structural integrity of the assembled tray.

Figure 3:
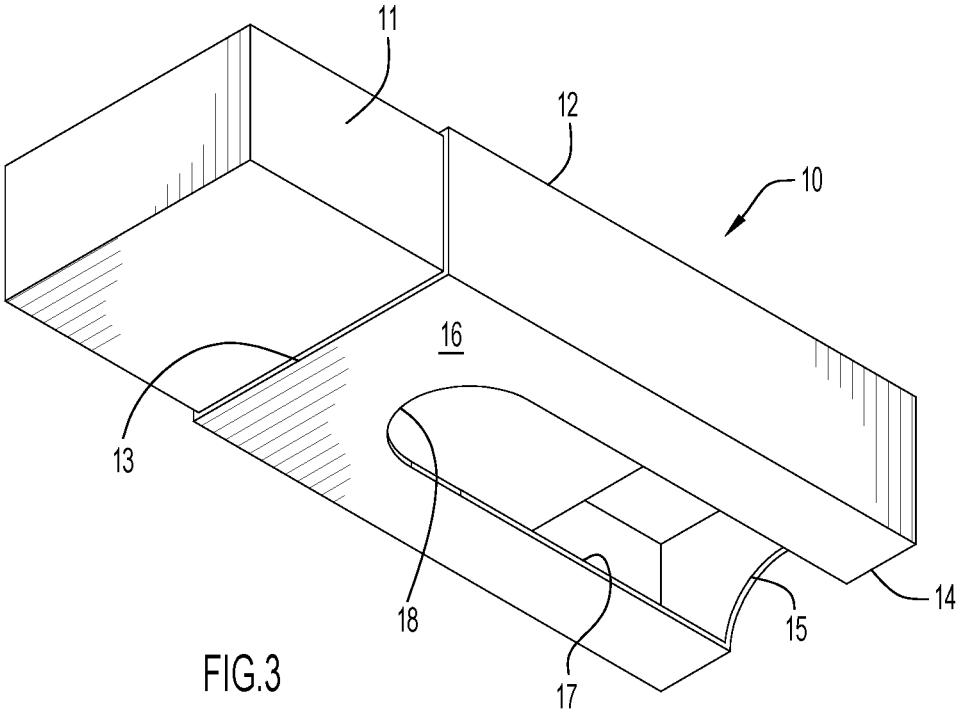
FIG. 3 is a front view in perspective from below of the container of FIG. 1 shown partially open.
Figure 4:
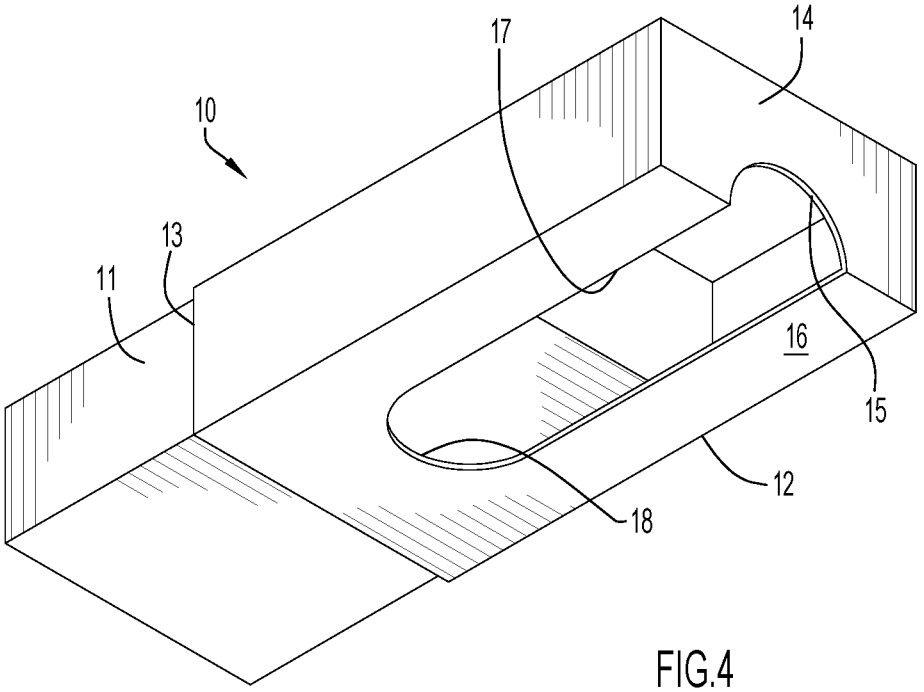
FIG. 4 is a is a rear view in perspective from below of the container of FIG. 1 shown partially open.
Figure 5:
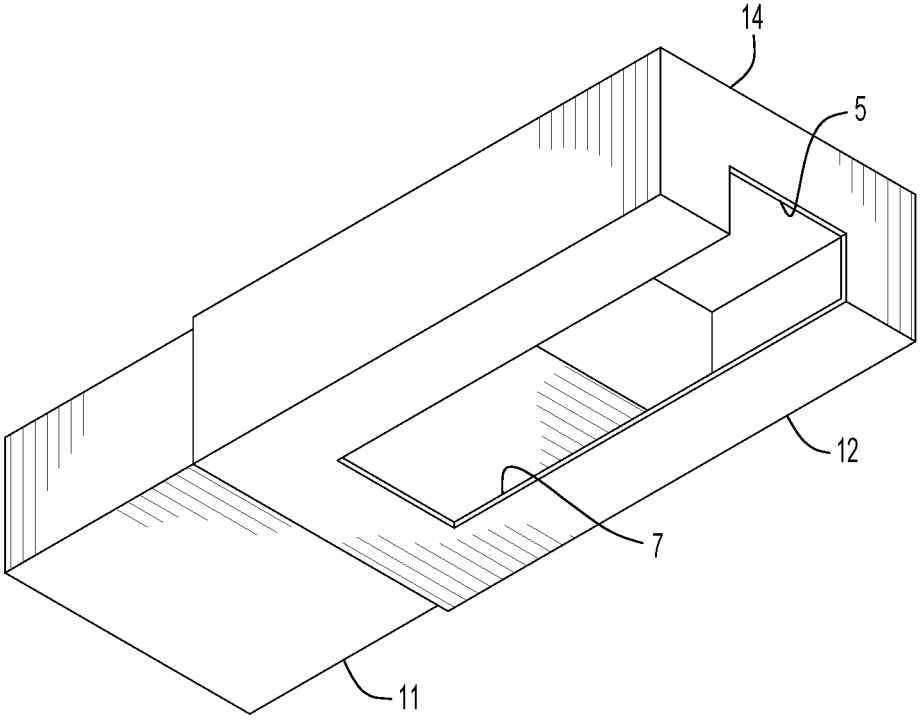
FIG. 5 is a rear view in perspective from below of a container shown partially open according to a second embodiment of the present invention.

Importantly, the aperture 15, although preferably arcuate as shown in FIGS. 3, 4 and 6, can be substantially any configuration that is consistent with the intended function and operation described herein. For example, the aperture can be rectangular, as shown in FIG. 6 as aperture 5, triangular, polygonal, or any regular or irregular shape. The important point is that the aperture is directly communicative with slot 17 (shown as slot 7 in FIG. 6) so that a user's finger can enter the aperture and be moved substantially unimpeded through the slot. Slot 7 is also shown with a transversely straight distal end, which is an alternative to the arcuate distal end of slot 17 in FIGS. 3 and 4.

The key elements of the invention work in concert in that the combination of the aperture 15 and the channel 17 allows a single finger of a user to access and fully-extend the tray within the sleeve. This is in direct contrast to prior art modifications of traditional matchbox structures in different ways and for different functions. In more than a hundred years of design and re-design of the traditional matchbox shape, no prior configuration has introduced an apertured proximal end wall as a way to more easily access the back of the tray to push it forward or, separately and in conjunction, introduced the channel as a means for easily and efficiently permitting the tray to be pushed forward for accessing the full contents of the tray whether they are stored length-wise or width-wise. For people who engage in activities in the outdoors in cold climates, the present invention will improve their comfort level and safety when manipulating the tray in the sleeve.

The present invention is also an improvement in environmental efficiency in that it allows greater ease of access to the full contents of the box, improves access and performance for users, and uses less raw material in the manufacture of the product.

Although the sleeve and tray in the disclosed embodiments are concentric rectangular parallelepipeds, it is to be understood that they can have other configurations such as, for example, circular, elliptical or polygonal cylinders or tubes, as long as the sleeve is open at its distal end and there is an aperture in the proximal end wall in spatial longitudinal communication with a channel defined along part of the length of the sleeve bottom wall. In any of these embodiments, the user can slide the tray so that it can be partially (or, if desired, fully) extended from the open end of the sleeve by merely pushing with one finger though the rear sleeve wall aperture and along channel in the bottom wall.

Although specific terms are employed herein, they are used in a generic and descriptive sense only and not for purposes of limitation.

Having described preferred embodiments of new and improved matchbox-type packaging, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A package of the matchbox type comprising:

a tray having proximal and distal ends;

a sleeve for receiving said tray in longitudinally slidable relation within the sleeve;

wherein said sleeve comprises:

sidewalls and a top wall which are entirely closed;

an open distal end configured to permit the distal end of the tray to be extended longitudinally therefrom;

a proximal end wall having a bottom edge and an aperture defined through the proximal end wall at said bottom edge;

a bottom wall having a longitudinally extending channel defined therethrough and extending distally from and in unimpeded longitudinally continuous communication with said aperture;

wherein the aperture and channel are configured to permit a user to expose contents of said tray by contacting the proximal end of the tray through the aperture and pushing the tray unimpededly through the channel to move the proximal end of the tray in a distal direction longitudinally in the sleeve;

wherein said sleeve has a length dimension and said channel extends between 50% and 85% of said length dimension to allow a single finger on one hand of a user to access the channel and fully-extend said tray outward of the open distal end of said sleeve without requiring use of a user's other hand to pull the tray from the open distal end.

2. The package of claim 1, wherein said sleeve and said tray each have a rectangular parallelepiped configuration.

3. The package of claim 2, wherein said aperture is arcuate in the form of a segment of a circle.

4. The package of claim 2, wherein said aperture is polygonal.

5. The package of claim 2, wherein said channel has a width of at least approximately 12 mm.

6. The package of claim 1, wherein said aperture is arcuate in the form of a segment of a circle.

7. The package of claim 1, wherein said aperture is polygonal.

8. The package of claim 7, wherein said aperture is rectangular.

9. The package of claim 1, wherein said channel has a width of at least approximately 12 mm.

10. The package of claim 1, wherein the channel has a width transversely of the sleeve in the range of 36%-66% of the sleeve width.

11. The package of claim 1, wherein the sleeve and tray are separately fabricated from cardboard blanks.

12. The package of claim 1, wherein the aperture and channel are configured to permit a user to expose contents of said tray by inserting said finger through the aperture and unimpededly into the channel to push the proximal end of the tray in a distal direction longitudinally in the sleeve.

13. A method of opening a package of the matchbox type that includes a sleeve with sidewalls and a top wall which are entirely closed, an open distal end, a proximal end wall having an aperture defined therethrough, and a bottom wall having a longitudinally extending channel defined therethrough, and an open top tray configured to be longitudinally slidable in the sleeve, the method comprising:

(a) pushing the tray distally in the sleeve through the aperture defined through the proximal end wall of said sleeve; and (b) continuing to push the tray distally in the sleeve through the channel defined through the bottom wall of said sleeve a distance from the aperture at least equal to 50% of the length of the sleeve to fully-extend the tray outward of the open distal end, the channel and aperture being in uninterrupted longitudinal communication such that steps (a) and (b) are effected by a continuous unimpeded pushing of the tray distally through the sleeve by a single finger on one hand of a user without requiring use of a user's other hand to pull the tray from the open distal end.

14. The method of claim 13, wherein the step (a) is effected by a user extending an index finger of one hand through said aperture while holding the sleeve between a thumb and at least one other digit of the same hand, and step (b) is effected by said index finger extending through and moving distally along said channel while the user continues holding the sleeve between the thumb and said at least one other digit of the same hand.

* * * * *